US009970694B2

(12) United States Patent
David et al.

(10) Patent No.: US 9,970,694 B2
(45) Date of Patent: May 15, 2018

(54) COOLANT CONDENSER ASSEMBLY

(75) Inventors: Guillaume David, Rochester, MI (US); Uwe Förster, Erdmannhausen (DE); Matthias Jung, Stuttgart (DE); Andreas Kemle, Tamm (DE); Christoph Walter, Stuttgart (DE); Herbert Hofmann, Stuttgart (DE)

(73) Assignee: MAHLE International GmbH, Stuttgart (DE)

( * ) Notice: Subject to any disclaimer, the term of this patent is extended or adjusted under 35 U.S.C. 154(b) by 971 days.

(21) Appl. No.: 13/817,163

(22) PCT Filed: Aug. 19, 2011

(86) PCT No.: PCT/EP2011/064320

§ 371 (c)(1),
(2), (4) Date: Apr. 29, 2013

(87) PCT Pub. No.: WO2012/022806

PCT Pub. Date: Feb. 23, 2012

(65) Prior Publication Data

US 2013/0219932 A1 Aug. 29, 2013

(30) Foreign Application Priority Data

Aug. 19, 2010 (DE) ..... 10 2010 039 511

(51) Int. Cl.
*F25B 1/00* (2006.01)
*F25B 39/04* (2006.01)
(Continued)

(52) U.S. Cl.
CPC ..... *F25B 39/04* (2013.01); *F25B 40/02* (2013.01); *F25B 2339/0444* (2013.01); *F28D 2021/0084* (2013.01)

(58) Field of Classification Search
CPC .. F25B 39/04; F25B 40/02; F25B 2339/0444; F25B 2339/044; F28D 2021/0084;
(Continued)

(56) References Cited

U.S. PATENT DOCUMENTS 5,482,112 A 1/1996 Sasaki et al.
5,875,650 A 3/1999 Nobuta et al.
(Continued)

FOREIGN PATENT DOCUMENTS

DE 198 30 329 A1 1/1999
DE 10 2007 018 722 A1 9/2008
(Continued)

OTHER PUBLICATIONS

Machine Translation of EP 1577629, Behr Lorraine, Sep. 21, 2005.*
(Continued)

*Primary Examiner* — Frantz Jules
*Assistant Examiner* — Joseph Trpisovsky
(74) *Attorney, Agent, or Firm* — Paul D. Strain, Esq.; Strain & Strain PLLC

(57) ABSTRACT

This application relates to a coolant condenser assembly for an air conditioning system for a motor vehicle. In a supercooling region, at least two cooling pipes, as the first supercooling parallel section, are acted upon in parallel by the coolant in a fluid-conducting manner, the coolant which flows out of the first supercooling parallel section flows into a first supercooling intermediate flow duct, and the first supercooling intermediate flow duct opens into at least two cooling pipes as the second supercooling parallel section, and the second supercooling parallel section opens into a second supercooling intermediate flow duct and the second supercooling intermediate flow duct opens into at least two cooling pipes as the third supercooling parallel section, such
(Continued)

that the outlet opening is disposed on a second longitudinal side of the coolant condenser assembly.

11 Claims, 3 Drawing Sheets

(51) Int. Cl.
*F25B 40/02* (2006.01)
*F28D 21/00* (2006.01)

(58) Field of Classification Search
CPC ..... F28D 1/05391; F28D 1/05366; F28D 1/05375; F28D 1/05383; F28D 1/05325; F28D 1/05341; F28D 1/0417
USPC ..... 62/115, 507; 165/42, 151, 153, 173–176
See application file for complete search history.

(56) References Cited

U.S. PATENT DOCUMENTS

| | | | | |
|---|---|---|---|---|
| 6,470,704 | B2 | 10/2002 | Shibata et al. | |
| 2002/0007646 | A1* | 1/2002 | Manaka | F25B 39/04 62/506 |
| 2004/0200234 | A1 | 10/2004 | Seno et al. | |
| 2009/0249827 | A1* | 10/2009 | Ujiie | C09K 5/045 62/509 |
| 2010/0122545 | A1* | 5/2010 | Minor | C08J 9/146 62/324.1 |

FOREIGN PATENT DOCUMENTS

| | | | |
|---|---|---|---|
| EP | 1 365 200 | A1 | 11/2003 |
| EP | 1 531 309 | A2 | 5/2005 |
| EP | 1 577 629 | A1 | 9/2005 |
| EP | 1 887 295 | A1 | 2/2008 |
| EP | 2 056 043 | A1 | 5/2009 |
| FR | 2 915 793 | A1 | 11/2008 |
| JP | 11-211277 | A | 8/1999 |
| JP | 2003-21432 | A | 1/2003 |

OTHER PUBLICATIONS

International Search Report, PCT/EP2011/064320, dated Nov. 24, 2011, 3 pgs.
German Search Report, DE 10 2010 039 511.0, dated Jun. 10, 2011, 5 pgs.

* cited by examiner

COOLANT CONDENSER ASSEMBLY

CROSS-REFERENCE TO RELATED PATENT APPLICATIONS

This application is a National Stage of International Application No. PCT/EP2011/064320, filed Aug. 19, 2011, which is based upon and claims the benefit of priority from prior German Patent Application No. 10 2010 039 511.0, filed Aug. 19, 2010, the entire contents of all of which are incorporated herein by reference in their entirety.

The present invention relates to a refrigerant condenser assembly as per the preamble of claim 1, to a method for operating a refrigeration circuit of a motor vehicle air-conditioning system as per the preamble of claim 9, and to a motor vehicle air-conditioning system as per the preamble of claim 11.

In refrigerant condenser assemblies for a motor vehicle air-conditioning system, vaporous refrigerant is changed into a liquid state of aggregation, and the liquid refrigerant is subsequently "supercooled" further in a supercooling region. The refrigerant condenser assembly forms a part of a refrigeration circuit of a motor vehicle air-conditioning system with an evaporator, an expansion element and a compressor.

DE 10 2007 018 722 A1 presents a condenser for the air-conditioning system of a motor vehicle, which condenser has two collecting tubes and a vessel, which is arranged adjacent to one collecting tube, for accommodating the drying agent for the refrigerant of the air-conditioning system.

When using the new refrigerant R1234yf, in relation to the previous refrigerant R134a, a reduction in power of the refrigeration circuit of a motor vehicle air-conditioning system in the range of up to 10% arises owing to changed substance properties of the new refrigerant R1234yf. The power of a refrigeration circuit in a motor vehicle air-conditioning system may be increased inter alia by virtue of the already liquefied refrigerant being cooled more intensely at a supercooling region of the refrigerant condenser assembly.

In a refrigerant condenser assembly, the refrigerant enters the refrigerant condenser assembly in gaseous form at an inlet opening and is cooled to a saturation temperature at a superheat region. The refrigerant subsequently flows into a condensation region, and in said condensation region the gaseous refrigerant is cooled further to a boiling temperature and is thus liquefied. The liquid refrigerant subsequently flows into a supercooling region and is cooled below the boiling temperature, for example to a temperature of 6 or 7 K below the boiling temperature, of the refrigerant. Through more intense cooling of the refrigerant below the boiling temperature of the refrigerant in the supercooling region, it is possible to achieve a higher power of the refrigeration circuit. In general, however, there is a predefined structural space, predefined for example by a certain structural depth, structural height and structural width, available for the refrigerant condenser assembly within the motor vehicle, such that, although more intense cooling of the refrigerant at the supercooling region is possible by means of a larger surface area at the supercooling region and an associated larger structural space of the refrigerant condenser assembly, a larger structural space is generally not available owing to the predefined dimensions of the structural space for the refrigerant condenser assembly.

To increase the power of the refrigerant circuit or to compensate the reduced power of the refrigerant, in particular of the refrigerant R1234yf, it is sought to boost the supercooling to for example 15K. More cooling tubes or proportionally more area of the condenser are/is required for this purpose. This has the result that less area is available for the condensation region, the cooling takes place to a higher saturation temperature, and the associated saturation pressure rises. In the refrigerant circuit, this has an adverse effect on the refrigeration power, which reduces or even annuls the advantage sought.

For this purpose, U.S. Pat. No. 6,470,704 B2 proposes a supercooling region which is divided into a first and a second supercooling parallel portion. The disadvantage of said arrangement lies in the fact that the outlet opening and the collecting tank are arranged on the same side of the refrigerant condenser assembly. In many installation situations, it is desirable for the outlet opening and the collecting tank to be arranged on different longitudinal sides of the refrigerant condenser assembly.

It is therefore the object of the present invention to provide a refrigerant condenser assembly, a method for operating a refrigeration circuit of a motor vehicle air-conditioning system, and a motor vehicle air-conditioning system, wherein the refrigerant is cooled intensely in a supercooling region of the refrigerant condenser assembly without the condensation pressure in the refrigerant condenser assembly rising significantly and without the outlet opening and the collecting tank being arranged on different longitudinal sides of the refrigerant condenser assembly.

Said object is achieved by means of a refrigerant condenser assembly for a motor vehicle air-conditioning system, comprising an inlet opening for the introduction of a refrigerant, an outlet opening for the discharge of a refrigerant, cooling tubes for conducting a refrigerant, two collecting tubes for fluidically connecting the cooling tubes, a collecting tank having at least one flow transfer opening via which the collecting tank is fluidically connected to the cooling tubes and/or to a collecting tube, wherein the collecting tank is arranged at a first longitudinal side of the refrigerant condenser assembly, the cooling tubes have a superheat region for cooling the vaporous refrigerant, a condensation region for condensing the refrigerant, and a supercooling region for cooling the liquid refrigerant, wherein, in the supercooling region, at least two cooling tubes as a first supercooling parallel portion are charged with the refrigerant in parallel in terms of fluid conduction, the refrigerant flowing out of the first supercooling parallel portion issues into a first supercooling intermediate flow duct, and the first supercooling intermediate flow duct issues into at least two cooling tubes as a second supercooling parallel portion, and the second supercooling parallel portion issues into a second supercooling intermediate flow duct and the second supercooling intermediate flow duct issues into at least two cooling tubes as a third supercooling parallel portion, such that the outlet opening is arranged on a second longitudinal side of the refrigerant condenser assembly.

The supercooling region of the refrigerant condenser assembly is thus divided into a total of three supercooling parallel portions that are connected to one another in each case by a supercooling intermediate flow duct. The refrigerant can thereby be cooled even further below the boiling temperature of the refrigerant at the supercooling region.

Furthermore, as a result of the three supercooling parallel portions, the outlet opening and the collecting tank are arranged on opposite longitudinal sides of the refrigerant condenser assembly. It is thus preferably possible for a collecting tank to be provided which has a larger collecting volume than that according to the prior art. It is also preferably the case that the inlet opening and outlet opening are arranged on the same longitudinal side of the refrigerant condenser assembly.

The supercooling region of the refrigerant condenser assembly is thus divided into a first, a second and a third supercooling parallel portion, and in the supercooling parallel portions, in each case at least two cooling tubes are charged with the refrigerant in parallel in hydraulic terms or in terms of fluid conduction. Here, the refrigerant that emerges from the first supercooling parallel portion is introduced into a first supercooling intermediate flow duct, mixed therein, and the refrigerant is introduced from the first supercooling intermediate flow duct into the second supercooling parallel portion. The refrigerant that emerges from the second supercooling parallel portion is subsequently introduced into a second supercooling intermediate flow duct, mixed therein, and the refrigerant is introduced from the second supercooling intermediate flow duct into the third supercooling parallel portion. The refrigerant is subsequently discharged from the refrigerant condenser assembly through the outlet opening. It is thus advantageously possible for the refrigerant to be cooled more intensely at the supercooling region, for example to a temperature of 14 K below the boiling temperature of the refrigerant, without the dimensions of the refrigerant condenser assembly having to be increased in the process, and the refrigerant condenser assembly can thus be accommodated in a predefined structural space in a motor vehicle. It is thus possible for the power of a refrigeration circuit of a motor vehicle air-conditioning system to be improved and for the power reduction when using the new refrigerant R1234yf to be at least partially compensated thereby.

Here, an increased pressure drop in the supercooling region generated by the three supercooling parallel portions is not detrimental to the power of the refrigerant condenser assembly, or does not have a power-reducing effect. This can be attributed to the fact that the pressure drop takes place downstream of the saturated steam area, whereas the high pressure of the system relates to the saturation temperature upstream of the supercooling region and downstream of the condensation region.

It is preferable, in particular for the utilization of the fill volume of a laterally arranged collecting tank, for flow to pass through the three supercooling parallel portions from bottom to top. The third supercooling parallel portion is thus arranged geodetically higher than the second supercooling parallel portion, whereas the second supercooling parallel portion is arranged geodetically higher than the first supercooling parallel portion. It is self-evidently alternatively also possible for flow to pass through the three supercooling parallel portions from top to bottom.

In a further embodiment, in each case one supercooling parallel portion has two, three or four cooling tubes which are charged in parallel, and/or the surface area of the cooling tubes and preferably of the collecting tubes of the supercooling region amounts to less than 50%, 40%, 35%, 30%, 25% or 15% of the surface area of the heat exchanger of the refrigerant condenser assembly, and in particular, the heat exchanger is composed of the cooling tubes and preferably the collecting tubes.

In a supplementary embodiment, upstream of the first supercooling parallel portion as viewed in the flow direction of the refrigerant, at least two cooling tubes as a first parallel portion are charged in parallel in terms of fluid conduction, the refrigerant flowing out of the first parallel portion issues into a first intermediate flow duct, and the first intermediate flow duct issues into at least two cooling tubes as a second parallel portion. It is thus the case that a first and a second parallel portion are arranged upstream of the first supercooling parallel portion as viewed in the flow direction of the refrigerant, that is to say upstream of the supercooling region of the refrigerant condenser assembly, that is to say therefore at the superheat region and/or at the condensation region of the refrigerant condenser. The superheat region and/or the condensation region are thus divided into the first and second parallel portions, between which the refrigerant is conducted through the first intermediate flow duct.

In a supplementary embodiment, upstream of the first supercooling parallel portion as viewed in the flow direction of the refrigerant, the refrigerant flowing out of the second parallel portion issues into a second intermediate flow duct, and the second intermediate flow duct issues into at least two cooling tubes as a third parallel portion. Upstream of the supercooling region, that is to say therefore at the superheat region and/or at the condensation region of the refrigerant condenser assembly, the refrigerant condenser assembly is thus divided into a total of three parallel portions with at least two, preferably at least four or six or eight, cooling tubes, which are connected to one another in terms of fluid conduction in each case by the intermediate flow duct. It is preferable here for a parallel portion to have a greater number of cooling tubes than a supercooling parallel portion, and it is preferable for the number of cooling tubes of a parallel portion to be greater than the number of cooling tubes of a supercooling parallel portion by two, three, five or seven cooling tubes.

It is preferably the case that the second parallel portion issues into a second intermediate flow duct and the second intermediate flow duct issues into the collecting tank, or the third parallel portion issues into a third intermediate flow duct and the third intermediate flow duct issues into the collecting tank. If the superheat and/or condensation region of the refrigerant condenser assembly has the first and the second parallel portion, the refrigerant discharged from the second parallel portion is thus introduced into the collecting tank and subsequently into the first supercooling parallel portion, or if the superheat and/or condensation region has three parallel portions, the refrigerant discharged from the third parallel portion is introduced into the collecting tank and subsequently into the first supercooling parallel portion. This also applies analogously if the superheat and/or condensation region is divided into more than three parallel portions, for example four or five parallel portions.

It is alternatively possible for exactly one parallel portion to be provided, such that said exactly one parallel portion issues into the collecting tank.

By means of intensive measurements, it has been found that the following relationship with regard to the number of cooling tubes is preferable:

superheat region: 15 cooling tubes condensation region: 12 cooling tubes (wherein the condensation region is divided into a first parallel portion with 7 cooling tubes and a second parallel portion with 5 cooling tubes)

supercooling region: 9 cooling tubes (wherein the supercooling region is divided into a first, a second and a third supercooling parallel portion with in each case 3 cooling tubes).

In one variant, the sum total of the flow cross-sectional areas of the cooling tubes of a supercooling parallel portion is less than the product of 1.0 or 0.9 or 0.7 or 0.5 or 0.3 or 0.1 and the sum total of the flow cross-sectional areas of the cooling tubes of a parallel portion, and/or the cooling tubes are formed as flat tubes and corrugated fins are arranged between the flat tubes. The flow cross-sectional area is the cross-sectional area of the cooling tubes for conducting the refrigerant.

A method according to the invention for operating a refrigeration circuit of a motor vehicle air-conditioning system, having the steps: conducting refrigerant through lines of a refrigerant circuit, compressing the gaseous refrigerant in a compressor, such that the pressure of the gaseous refrigerant is increased, cooling, condensing and supercooling the gaseous refrigerant in a refrigerant condenser assembly, which refrigerant is conducted through cooling tubes, by virtue of the gaseous refrigerant being cooled to a saturation temperature in a superheat region, the gaseous refrigerant subsequently being cooled to a boiling temperature and liquefied in a condensation region, and the liquid refrigerant being cooled below the boiling temperature in a supercooling region, expanding the liquid refrigerant at an expansion element such that the pressure of the liquid refrigerant is reduced, heating and evaporating the refrigerant in an evaporator, conducting the gaseous refrigerant emerging from the evaporator to the compressor, wherein, in the supercooling region of the condenser, the refrigerant is conducted in parallel through at least two cooling tubes of a first supercooling parallel portion, the refrigerant flowing out of the first supercooling parallel portion is conducted into a first supercooling intermediate flow duct, and the refrigerant conducted through the first supercooling intermediate flow duct is subsequently conducted in parallel through at least two cooling tubes of a second supercooling parallel portion, and the second supercooling parallel portion issues into a second supercooling intermediate flow duct, and the second supercooling intermediate flow duct issues into at least two cooling tubes as a third supercooling parallel portion, and/or, in the supercooling region, the refrigerant is conducted through cooling tubes with a smaller flow cross-sectional area than the refrigerant that is conducted through the cooling tubes of the superheat region and/or of the condensation region, such that the refrigerant conducted through the cooling tubes in the supercooling region has a greater volume flow rate than the refrigerant conducted through the cooling tubes in the superheat region and/or in the condensation region.

The volume flow rate of the refrigerant in the cooling tubes of the supercooling region is expediently 1.0 or 1.2 or 1.5 or 2 times greater than the volume flow rate of the refrigerant in the cooling tubes of the superheat region and/or of the condensation region, and/or the refrigerant in the supercooling region is cooled by more than 7, 10, 12 or 14 K and preferably by less than 30 K or 20 K. Owing to the greater volume flow rate of the refrigerant in the cooling tubes of the supercooling region in relation to a supercooling region with only exactly one supercooling parallel portion, and the associated greater flow speed of the refrigerant in the supercooling region, it is thereby possible to attain an improved transfer of heat from the refrigerant to the air which flows around the refrigerant condenser assembly.

Motor vehicle air-conditioning system according to the invention, comprising a refrigerant condenser assembly, an evaporator, a compressor, preferably a fan, preferably a housing for accommodating the fan and the evaporator, wherein the refrigerant condenser assembly is designed as a refrigerant condenser assembly described in this property right application and/or a method as described in this property right application can be implemented by the motor vehicle air-conditioning system.

In an additional embodiment, the refrigerant is R1234yf or R134a.

In one variant, the refrigerant condenser assembly has a closure device formed on the collecting tank for closing off a closure opening of the collecting tank.

A dryer and/or a filter are/is preferably arranged in the collecting tank.

An exemplary embodiment of the invention will be described in more detail below with reference to the appended drawings, in which.

Figure 1:
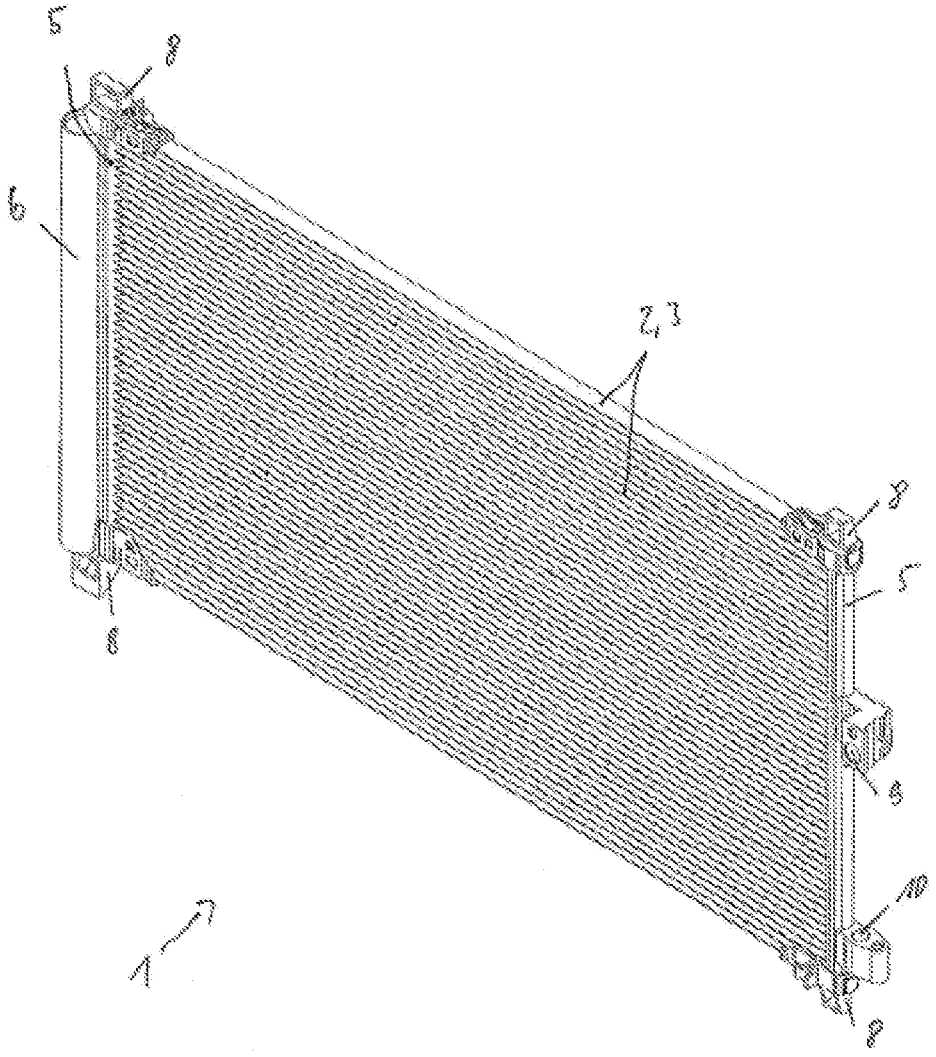
FIG. 1 shows a perspective view of a refrigerant condenser assembly.
Figure 2:
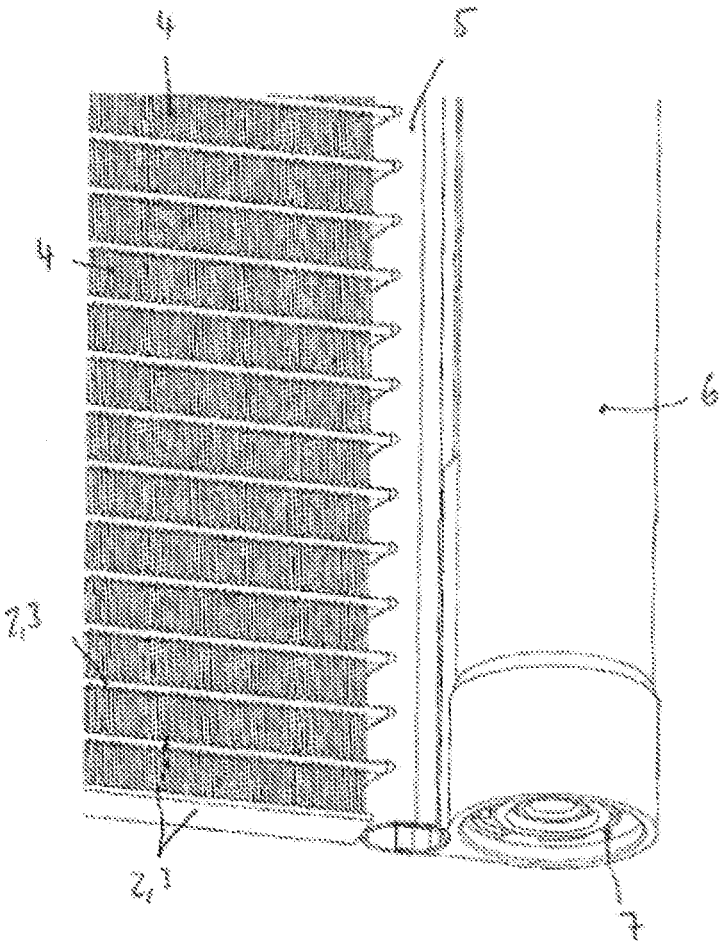
FIG. 2 shows a perspective partial view of the refrigerant condenser assembly as per FIG. 1.

FIGS. 1 and 2 illustrate a refrigerant condenser assembly 1 in a perspective view. The refrigerant condenser assembly 1 is a constituent part of a motor vehicle air-conditioning system with an evaporator and a compressor (not illustrated). Refrigerant to be condensed and to be cooled flows through horizontally arranged cooling tubes 2 as flat tubes 3 (FIGS. 1 and 2). The cooling tubes 2 issue at their respective ends into a vertical collecting pipe 5, that is to say two collecting tubes 5 are provided, in each case on the ends of the cooling tubes 2. Only one collecting tube 5 is illustrated in FIG. 2. For this purpose, the collecting tube 5 has cooling tube openings through which the ends of the cooling tubes 2 project into the collecting tube 5. Within the collecting tubes 5 there are formed guiding plates (not illustrated) by means of which a defined flow path of the refrigerant through the cooling tubes 2 can be realized, such that the refrigerant flows through the cooling tubes 2 as per the schematic flow diagram in FIG. 3.

Between the cooling tubes 2 there are arranged meandering corrugated fins 4 which are thermally connected to the cooling tubes 2 by means of heat conduction. In this way, the surface area available for cooling the refrigerant is enlarged. The cooling tubes 2, the corrugated fins 4 and the two collecting tubes 5 are generally composed of metal, in particular aluminum, and are connected to one another cohesively by means of a brazed connection. In four corner regions of the refrigerant condenser assembly 1 there is arranged a fastening device 8 by means of which the refrigerant condenser assembly can be fastened to a motor vehicle, in particular to a body of a motor vehicle.

On a first longitudinal side of the collecting tube 5 there is arranged a collecting tank 6 which is likewise oriented vertically (FIGS. 1, 2). The collecting tank 6 is fluidically connected via two flow transfer openings (not illustrated) to the collecting tube 5 and is thus also indirectly fluidically connected to the cooling tubes 2. In the collecting tank 6 there are arranged a dryer and a filter (not illustrated). The dryer is hygroscopic and can absorb water or moisture from the refrigerant. The collecting tank 6 is mechanically connected at the bottom end and at the top end to the collecting tube 5 by means of a concave abutment region. At the bottom end, the collecting tank 6 is closed off in a fluid-tight manner by a closure device 7. The removable closure device 7 permits an exchange of the dryer and of the filter in the collecting tank 6.

Figure 3:
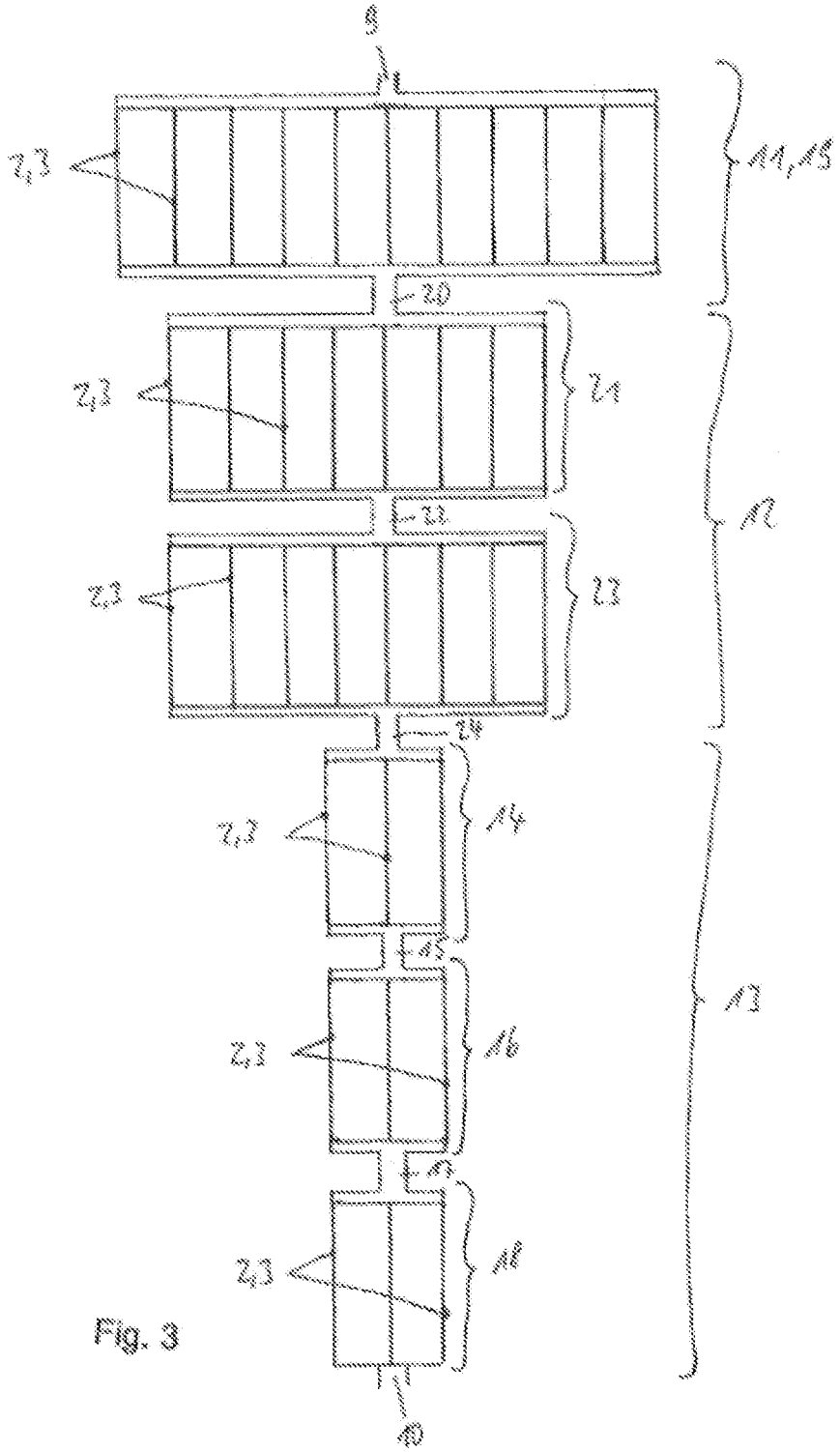
FIG. 3 shows a schematic flow diagram of the refrigerant in the refrigerant condenser assembly as per FIG. 1.

The refrigerant condenser assembly 1 has an inlet opening 9 for the introduction of the refrigerant R1234yf into the refrigerant condenser assembly 1 and has an outlet opening 10 for the discharge of the refrigerant from the refrigerant condenser assembly 1 (FIGS. 1 and 3). Here, the ends of the cooling tubes 2 terminate in the collecting tubes 5. In the collecting tubes 5 there are arranged guiding plates or flow guiding plates (not illustrated) by means of which a certain predefined flow configuration of the refrigerant can be realized, that is to say on which flow path the refrigerant flows through the multiplicity of cooling tubes 2, arranged one above the other, of the refrigerant condenser assembly 1. The schematic flow diagram illustrated in FIG. 3 serves merely as a diagrammatic illustration of the flow path of the refrigerant through the cooling tubes 2 and does not represent a geometric orientation of the cooling tubes 2 with respect to one another in the refrigerant condenser assembly 1. A first intermediate flow duct 20, a second intermediate flow duct 22, a third intermediate flow duct 24 and a first supercooling intermediate flow duct 15 and a second supercooling intermediate flow duct 17, which are illustrated in FIG. 3, are therefore formed within the collecting tubes 5 by the flow guiding plates (not illustrated).

The refrigerant condenser assembly 1 constitutes a heat exchanger for the transfer of heat from the refrigerant to air which surrounds and flows around the refrigerant condenser assembly 1. Here, the heat exchanger is formed substantially by the cooling tubes 2 and the two collecting tubes 5. Here, the heat exchanger as part of the refrigerant condenser assembly 1 has an inlet opening 9 through which gaseous refrigerant is conducted from a compressor (not illustrated) to the refrigerant condenser assembly 1. Here, the gaseous refrigerant is cooled, at a superheat region 11, to a saturation temperature, that is to say, at the saturation temperature, a condensation of the refrigerant occurs corresponding to the prevailing pressure. The superheat region 11 is followed, downstream in the flow direction of the refrigerant, by a condensation region 12 in which the refrigerant is condensed and thus liquefied. The refrigerant which is liquefied in the condensation region 12 is supplied as liquid to the supercooling region 13 and, in the supercooling region 13, is cooled below the boiling temperature of the refrigerant. Here, the clear partitioning into superheat region 11, condensation region 12 and supercooling region 13 defined in FIG. 3 may deviate slightly during the operation of a motor vehicle air-conditioning system, such that for example in a modification of the illustration in FIG. 3, the superheat region 11 is slightly larger and thus the condensation region 12 becomes smaller, such that for example a second parallel portion 21 also partially forms the superheat region 11. This applies analogously to the partitioning between the condensation region 12 and the supercooling region 13, which may either move into a first supercooling parallel portion 14 in the flow direction of the refrigerant or may move back into a third parallel portion 23 counter to the flow direction of the refrigerant.

The superheat region 11 is formed by the first parallel portion 19. Here, the first parallel portion 19 has eleven cooling tubes which are connected, and passed through by flow, in parallel in terms of fluid conduction or in hydraulic terms. After the refrigerant flows out of the eleven cooling tubes 2 of the first parallel portion 19, the refrigerant is introduced into the first intermediate flow duct 20 and is introduced from the first intermediate flow duct 20 into the second parallel portion 21. The second parallel portion 21 has eight cooling tubes 2 through which the refrigerant flows simultaneously in parallel. The refrigerant flowing out of the second parallel portion 21 is introduced into the second intermediate flow duct 22 and is introduced from the latter into the third parallel portion 23, which likewise has eight cooling tubes 2.

The refrigerant flowing out of the third parallel portion 23 is introduced into the third intermediate flow duct 24 and subsequently, after having flowed through the collecting tank 6, is supplied to the supercooling region 13 of the refrigerant condenser assembly 1. The supercooling region 13 comprises a first supercooling parallel portion 14, a second supercooling parallel portion 16 and a third supercooling parallel portion 18. Here, the three supercooling parallel portions 14, 16 and 18 have in each case three cooling tubes 2. The first supercooling parallel portion 14 is connected to the second supercooling parallel portion 16 by the first supercooling intermediate flow duct 15, and the second supercooling parallel portion 16 is analogously connected to the third supercooling parallel portion 18 by the second supercooling intermediate flow duct 17. It is thus the case that, in the refrigerant condenser assembly 1, the parallel portions 19, 21 and 23 and the supercooling parallel portions 14, 16 and 18 are connected in series in terms of fluid conduction, and the cooling tubes 2 at the parallel portions 19, 21 and 23 and at the supercooling parallel portions 14, 16 and 18 are connected in parallel in hydraulic terms or in terms of fluid conduction.

All of the refrigerant conducted through the refrigerant condenser assembly 1 thus flows through each of the parallel portions 19, 21 and 23 and the supercooling parallel portions 14, 16 and 18. Here, the supercooling parallel portions 14, 16 and 18 have a significantly lower number of cooling tubes 2 than the parallel portions 19, 21 and 23. Owing to the connection of the refrigerant condenser assembly 1 in terms of fluid conduction or in hydraulic terms, the refrigerant is provided with a significantly smaller flow cross-sectional area at the supercooling parallel portions 14, 16 and 18 than at the parallel portions 19, 21 and 23, because the cooling tubes 2 have the same flow cross-sectional area. As a result, a greater flow speed of the refrigerant or a greater volume flow rate of the refrigerant is generated at the supercooling parallel portions 14, 16 and 18 than at a supercooling region with only exactly one supercooling parallel portion. Owing to said greater flow speed or the greater volume flow rate of the refrigerant at the supercooling region 13, the heat transfer from the refrigerant to the air in the supercooling region 13 can be increased, and thus more heat can be transferred from the refrigerant to the air flowing around the refrigerant condenser assembly 1, and thus the refrigerant in the supercooling region 13 can be cooled more intensely below the boiling temperature of the refrigerant, for example can be cooled below the boiling temperature of the refrigerant by 14 K. It is thus advantageously possible for the COP of a refrigeration circuit to be increased. Owing to the adequately dimensioned flow cross-sectional area at the supercooling region 13, the pressure drop in the refrigerant condenser assembly 1 is not increased or is increased only slightly, such that as a result the high pressure at the inlet opening 9 rises only slightly, and thus the increase in power of the refrigeration circuit owing to the increased cooling at the supercooling region 13 is significantly greater than the power reduction owing to the possible increase in the high pressure at the inlet opening 9. After having flowed through the supercooling region 13, the refrigerant is discharged from the refrigerant condenser assembly through the outlet opening 10. As a result of the formation of three supercooling parallel portions, the outlet opening is arranged on a second longitudinal side of the refrigerant condenser assembly. The outlet opening and the collecting tank 6 are thus arranged on different longitudinal sides of the refrigerant condenser assembly.

In a further exemplary embodiment (not illustrated), the supercooling region 13 has only the first and second supercooling parallel portions 14, 16 and not the third supercooling parallel portion 18. In an additional exemplary embodiment (not illustrated), the supercooling region 13 may also be divided into a total of four or five supercooling parallel portions. It is however preferable for the supercooling region 13 to have an odd number of supercooling parallel portions, such that the collecting tank 6 and the outlet opening 10 are arranged on different sides of the refrigerant condenser assembly.

Viewed as a whole, the refrigerant condenser assembly 1 according to the invention is associated with significant advantages. The flow speed or the volume flow rate at the supercooling region 13 is greatly increased owing to the predefined flow configuration, such that it is thereby possible to realize more intense supercooling or cooling of the refrigerant at the supercooling region 13 without the refrigerant condenser assembly 1 requiring more installation space or surface area, because, owing to the greater flow speed, the heat transfer from the refrigerant to the air per unit of surface area of the refrigerant condenser assembly 1, in particular at the cooling tubes 2, the corrugated fins 4 or the collecting tubes 5 as the heat exchanger of the refrigerant condenser assembly 1, is increased. In this way, it is possible, with an unchanged structural space for the refrigerant condenser assembly 1, for the COP of a refrigeration circuit with the refrigerant condenser assembly 1 to be increased without additional structural space being required for the refrigerant condenser assembly 1. It is thus possible for the reduction in the COP owing to the use of the refrigerant R1234yf to be at least partially compensated.

LIST OF REFERENCE NUMERALS

1 Refrigerant condenser assembly
2 Cooling tube
3 Flat tube
4 Corrugated fin
5 Collecting tube
6 Collecting tank
7 Closure device on the collecting tank
8 Fastening device
9 Inlet opening
10 Outlet opening
11 Superheat region
12 Condensation region
13 Supercooling region
14 First supercooling parallel portion
15 First supercooling intermediate flow duct
16 Second supercooling parallel portion
17 Second supercooling intermediate flow duct
18 Third supercooling parallel portion
19 First parallel portion
20 First intermediate flow duct
21 Second parallel portion
22 Second intermediate flow duct
23 Third parallel portion
24 Third intermediate flow duct

The invention claimed is:

1. A refrigerant condenser assembly for a motor vehicle air-conditioning system, comprising an inlet opening for the introduction of a refrigerant, an outlet opening for the discharge of the refrigerant, cooling tubes for conducting the refrigerant, two collecting tubes for fluidically connecting the cooling tubes, a collecting tank having at least one flow transfer opening via which the collecting tank is fluidically connected to the cooling tubes and/or to the collecting tubes, wherein the collecting tank is arranged at a first longitudinal side of the refrigerant condenser assembly, the cooling tubes have a superheat region for cooling the vaporous refrigerant, a condensation region for condensing the refrigerant, and a supercooling region for cooling the liquid refrigerant, wherein the condensation region is divided in parallel portions containing equal numbers of tubes, wherein, in the supercooling region, at least two cooling tubes as a first supercooling parallel portion are charged with the refrigerant in parallel in terms of fluid conduction, the refrigerant flowing out of the first supercooling parallel portion issues into a first supercooling intermediate flow duct, and the first supercooling intermediate flow duct issues into at least two cooling tubes as a second supercooling parallel portion, wherein, in the supercooling region, the second supercooling parallel portion issues into a second supercooling intermediate flow duct and the second supercooling intermediate flow duct issues into at least two cooling tubes as a third supercooling parallel portion, such that the outlet opening is arranged on a second longitudinal side of the refrigerant condenser assembly, wherein the first supercooling parallel portion and the second supercooling parallel portion contain fewer cooling tubes than the parallel portions of the condensation region, wherein the parallel portions of the condensation region contain fewer cooling tubes than the superheat region, wherein, upstream of the first supercooling parallel portion as viewed in the flow direction of the refrigerant, at least two cooling tubes as a first parallel portion are charged in parallel in terms of fluid conduction, the refrigerant flowing out of the first parallel portion issues into a first intermediate flow duct, and the first intermediate flow duct issues into at least two cooling tubes as a second parallel portion, wherein, upstream of the first supercooling parallel portion as viewed in the flow direction of the refrigerant, the refrigerant flowing out of the second parallel portion issues into a second intermediate flow duct, and the second intermediate flow duct issues into at least two cooling nines as a third parallel portion.

2. The refrigerant condenser assembly as claimed in claim 1, wherein in each case one supercooling parallel portion has two, three, or four cooling tubes which are charged in parallel, wherein a total surface area of the cooling tubes and the collecting tubes of the supercooling region amounts to less than 50%, 40%, 35%, 30%, 25% or 15% of a total surface area of the heat exchanger of the refrigerant condenser assembly.

3. The refrigerant condenser assembly as claimed in claim 1, wherein, upstream of the first supercooling parallel portion as viewed in the flow direction of the refrigerant, at least two cooling tubes as a first parallel portion are charged in parallel in terms of fluid conduction.

4. The refrigerant condenser assembly as claimed in claim 1, wherein the second parallel portion issues into a second intermediate flow duct and the second intermediate flow duct issues into the collecting tank, or the third parallel portion issues into a third intermediate flow duct and the third intermediate flow duct issues into the collecting tank.

5. The refrigerant condenser assembly as claimed in claim 3, wherein the sum total of the flow cross-sectional areas of the cooling tubes of a supercooling parallel portion is less than the product of 1.0 or 0.9 or 0.7 or 0.5 or 0.3 or 0.1 and the sum total of the flow cross-sectional areas of the cooling tubes of a parallel portion, and/or the cooling tubes are formed as flat tubes and corrugated fins are arranged between the flat tubes.

6. The refrigerant condenser assembly as claimed in claim 1, wherein the third supercooling parallel portion is arranged spatially higher than the second supercooling parallel portion, and the second supercooling parallel portion is arranged spatially higher than the first supercooling parallel portion.

7. The refrigerant condenser assembly as claimed in claim 1, wherein the superheat region comprises 15 cooling tubes, the condensation region comprises 12 cooling tubes, and the supercooling region comprises 9 cooling tubes.

8. The refrigerant condenser assembly as claimed in claim 1, wherein the refrigerant exiting the supercooling region has a temperature at least 14K below the boiling point of the refrigerant.

9. The refrigerant condenser assembly as claimed in claim 1, wherein the ratio of cooling tubes in the superheat region, the condensation region, and the supercooling region is 15:12:9.

10. The refrigerant condenser assembly as claimed in claim 1, wherein the refrigerant comprises R1234yf.

11. The refrigerant condenser assembly as claimed in claim 1, wherein the superheat region is divided in parallel portions containing equal numbers of tubes.

* * * * *